United States Patent [19]

Siwinski

[11] Patent Number: 4,757,845

[45] Date of Patent: Jul. 19, 1988

[54] METHOD AND APPARATUS FOR BENDING WIRES

[75] Inventor: Paul P. Siwinski, Seminole, Fla.

[73] Assignee: AMP Incorporated, Harrisburg, Pa.

[21] Appl. No.: 40,510

[22] Filed: Apr. 20, 1987

[51] Int. Cl.[4] ..... B21F 45/00

[52] U.S. Cl. ..... 140/105; 140/71 R

[58] Field of Search ..... 140/1, 71 R, 105; 72/384, 385

[56] References Cited

U.S. PATENT DOCUMENTS

| | | | |
|---|---|---|---|
| 3,147,779 | 9/1964 | Brown | 140/105 |
| 3,519,033 | 7/1970 | Pepin | 140/1 |
| 3,636,991 | 1/1972 | Webster | 140/105 |
| 3,891,013 | 6/1975 | Folk et al. . | |
| 4,040,705 | 8/1977 | Huber . | |
| 4,076,365 | 2/1978 | Ross et al. . | |
| 4,094,566 | 6/1978 | Dola et al. . | |
| 4,108,217 | 8/1978 | Westberg, II | 140/105 |
| 4,125,137 | 11/1978 | Shatto, Jr. . | |
| 4,132,251 | 1/1979 | Folk et al. . | |
| 4,132,252 | 1/1979 | Shatto, Jr. . | |
| 4,140,360 | 2/1979 | Huber . | |
| 4,181,384 | 1/1980 | Dola et al. . | |
| 4,367,909 | 1/1983 | Shatto, Jr. et al. . | |
| 4,391,038 | 7/1983 | Greene et al. | 140/105 |
| 4,451,099 | 5/1984 | Bricker, Jr. et al. . | |
| 4,476,905 | 10/1984 | Maben | 140/105 |
| 4,614,028 | 9/1986 | Rich . | |
| 4,616,893 | 10/1986 | Feldman . | |

*Primary Examiner*—Lowell A. Larson
*Attorney, Agent, or Firm*—Robert W. Pitts

[57] ABSTRACT

Apparatus for bending or deploying selected, individual, stripped, electrical wires at the stripped free end of a ribbon cable. The apparatus comprises a base having a box-like recess with fixed components or plate-like members or shims to individually position the wires to be bent. The fixed components include tall positioning shims with notches extending downwardly to contact the insulating web of a ribbon cable between its stripped wires and to properly position the web and the wires. The fixed components also include short ground wire shims located between some of the tall positioning shims for receiving, thereadjacent, ground wires of the received ribbon cable. The fixed components also include short signal wire shims located between others of the tall positioning shims for receiving, thereadjacent, signal wires of the received ribbon cable. Also included within the apparatus are bending fingers operatively associated with the fixed components for reciprocal movement with respect thereto. The bending fingers are located in two rows on opposite sides of the notches, ribbon cable and wires for movement from retracted positions to advanced positions wherein the leading edges of the bending fingers contact and bend selected, individual stripped signal wires of the ribbon cable supported by, and positioned in, the fixed components. Also disclosed is the method of bending or deploying signal wires of a ribbon cable supported and positioned by the apparatus.

32 Claims, 10 Drawing Sheets

20
14
84
88
56
56
104
112
106
60
60
86

20
84
98
102
12
88
104
56
56
106
86

20
84
14
88
56
56
12
112
86

20
12
84
102
98
88
14
56
56
104
106
86

METHOD AND APPARATUS FOR BENDING WIRES

BACKGROUND OF THE INVENTION

1. Field of the Invention

This invention relates to bending wires and, more particularly, to a method and apparatus for bending selected, individual, electrical wires at the stripped end of a ribbon cable.

2. Description of the Prior Art

The development of new electrical cables in which a large number of wires are encapsulated in a flat insulating web has produced significant advantages in computers, telecommunication devices and the electronic industry generally. These cables are presently manufactured with conductors formed as fine parallel wires, as small as 0.030 inches in diameter, located on closely spaced centerlines. They may be used for transmitting either electrical power or electrical signals.

Along with the obvious advantages of size reduction and ease of handling, such flat cables also present certain disadvantages, both mechanical and electrical. From the mechanical standpoint, the fineness of the wires and the closeness of their spacing generally increase wire handling difficulties during the coupling of the individual wires to other electrical components such as connectors. Further, since their centerline spacings are unusually small, they may not necessarily coincide with the standard centerline spacings for commonly used electrical elements. This creates interconnection problems. The development of even smaller cables with finer, more closely spaced wires, further aggravates these mechanical problems. This, in turn, complicates both the design of connectors compatible with such further miniaturized cables as well as the interconnection of such cables to their connectors.

From the electrical standpoint, particularly when flat cables are used for signal transmission purposes, the closeness of wire centerlines dictates their positioning at a specific, precise, constant distance for a particular application if the accurate transmission of signals is to be accomplished. Of equal importance, when flat, multi-wire cables are coupled with connectors, such connectors must be designed for controlling the characteristic impedance of the transmitted signals while matching it to the ribbon cable as well as the electronic devices being coupled.

The prior art discloses many techniques for coupling ribbon cables to connectors. Note, for example, U.S. Pat. Nos. 4,094,566 to Dole et al; 4,181,384 also to Dole et al; and 4,367,909 to Shatto et al. None, however, discloses a method or apparatus for efficiently bending or deploying selected wires of a ribbon cable in order to facilitate the coupling of the ribbon cable wires to connectors as herein disclosed. Further, no prior art discloses a method or apparatus capable of bending selected, individual, electrical wires at the stripped end of a ribbon cable wherein such wires are as small as 0.008 inches in diameter as contemplated by the present invention. This is several times smaller than wires previously employed. Such significantly reduced wire diameters will allow for the proportionate reduction in the spacing between centerlines to 0.0125 inches along with a proportionate increase in the number of wires per ribbon cable to 81 wires per linear inch.

While U.S. Pat. No. 4,616,893 discloses a connector with controlled characteristic impedance between printed circuit boards, an environment in which the present invention finds particularility, there is no prior art teaching or suggestion of wire bending for flat, multi-wire, signal transmission cables. In addition, U.S. patent application Ser. No. 937,737 filed Dec. 4, 1986, in the name of Siwinski and commonly assigned to the assignee of the present application, discloses a connector with appropriately bent or deployed ribbon cable wires for coupling with a connector as disclosed herein. Such application, however, does not teach, disclose or even suggest any method or apparatus for conveniently and accurately bending such wires to facilitate their coupling.

Lastly, U.S. patent application Ser. No. 661,774 filed Oct. 17, 1984 in the name of Schwalm discloses the soldering of closely spaced bent wires as of a ribbon cable to connectors. Such disclosure, however, does not teach or suggest any method or apparatus for bending ribbon cable wires for use in association with connectors, let alone the inventive method and apparatus as contemplated herein.

None of these prior art patents teaches or suggests the accurate, efficient, convenient, and economical wire bending apparatus or method as described herein. Known methods and apparatus are simply lacking in one regard or another.

As illustrated by the prior patents, efforts are continuously being made in an attempt to more efficiently connect electrical elements of ever decreasing size. None of these prior art efforts, however, suggests the present inventive combination of method steps and component elements arranged and configured for bending the fine, closely spaced wires at the stripped end of a ribbon cable as disclosed and claimed herein. Prior methods and apparatus do not provide the benefits attendant with the present invention. The present invention achieves its purposes, objectives and advantages over the prior art methods and devices through a new, useful and unobvious combination of method steps and component elements, through the use of a minimum number of functioning parts, at a reduction in cost to manufacture and operate, and through the utilization of only readily available materials and conventional components.

These objects and advantages should be construed as merely illustrative of some of the more prominent features and applications of the present invention. Many other beneficial results can be attained by applying the disclosed invention in a different manner or by modifying the invention within the scope of the disclosure. Accordingly, other objects and advantages as well as a fuller understanding of the invention may be had by referring to the summary and detailed description of the preferred embodiment of the invention in addition to the scope of the invention as defined by the claims taken in conjunction with the accompanying drawings.

SUMMARY OF THE INVENTION

The present invention is defined by the appended claims with the specific preferred embodiment shown in the attached drawings. For the purposes of summarizing the invention, the invention may be incorporated into an apparatus for deploying selected, individual wires of the stripped free end of a ribbon cable. The ribbon cable is of the type formed of spaced, parallel, electrical wires in an insulating web. The apparatus comprises plate-like members coupled with respect to each other and adapted to position the individual wires at the stripped free end of a received ribbon cable. The apparatus also includes fingers operatively coupled with respect to each other and reciprocably arranged for movement for contacting and deploying selected, individual, electrical wires of the received and supported ribbon cable.

The invention may further be incorporated into an apparatus for bending selected, individual, stripped, electrical wires at the free end of a ribbon cable. The ribbon cable is of the type formed of spaced parallel wires in an insulating web. The apparatus includes a base having a recess. The apparatus also includes fixed components within the recess to individually position the stripped wires of a received ribbon cable. The fixed components include tall positioning shims with notches extending downwardly from their upper edges to contact a ribbon cable between its stripped wires and to properly position the web and the stripped wires with respect to the fixed components. The fixed components also include short ground wire shims located between some of the tall positioning shims to receive, thereadjacent, ground wires of the received ribbon cable. The fixed components also include short signal wire shims located between others of the tall positioning shims to receive, thereadjacent, signal wires of the received ribbon cable. The apparatus further includes bending fingers operatively associated with the fixed components for reciprocable movement with respect to said fixed components. The bending fingers are located in two rows on opposite sides of the wires to be bent for movement from retracted positions on opposite sides of the wires to be bent, to advanced positions wherein the leading edges of the bending fingers may contact and bend selected, individual stripped signal wires of a ribbon cable supported and positioned by the fixed components.

Further, the invention may be incorporated into apparatus for deploying individual wires of the stripped free end of a ribbon cable, the ribbon cable being formed of spaced, parallel wires in an insulating web. The apparatus comprises a plurality of tall plate-like members and short plate-like members alternately positioned and removably secured with respect to each other in a face to face array. The tall plate-like members have free edges to be contacted by the insulation of a ribbon cable at regions between the wire at the stripped free end to thereby separate and position the individual wires adjacent the short plate-like members and between the tall plate-like members. The apparatus further comprises deployment means located in operative association with respect to plate-like members and arranged for reciprocable movement between tall plate-like members for contacting and deploying individual wires of the received and supported ribbon cable.

Lastly, the invention may further be incorporated into a method of bending selected, individual wires at the stripped free end of a ribbon cable formed of parallel electrical wires in an insulating web. The method comprises the step of providing a base having an opening. The method also comprises the step of positioning fixed components within said opening to support the individual wires of a received ribbon cable. The fixed components include tall positioning shims with notches extending downwardly from their upper edges. The fixed components also include short signal wire shims located between some of the tall positioning shims to receive, adjacent their upper edges, alternate wires of the received ribbon cable. The fixed components also include short ground wire shims located between others of the tall positioning shims to receive wires other than the alternate wires of the received ribbon cable. The method further includes the step of inserting the stripped free end of a ribbon cable into the fixed components with the insulating web, between its stripped wires, in positioning contact with the notches of the tall positioning shims and with the individual stripped wires of the ribbon cable separated one from the other by the tall positioning shims. The method also includes the step of moving, from a retracted position to an advanced position, bending fingers within the opening. The bending fingers are arranged in two rows located out of contact with the wires when in their retracted position and in bending contact with the wires to be bent when in their advanced positions whereby the leading edges of the bending fingers may contact and bend selected signal wires of the supported and positioned ribbon cable during movement from the retracted to the advanced positions.

The foregoing has outlined rather broadly the more pertinent and important features of the present invention in order that the detailed description of the invention that follows may be better understood whereby the present contribution to the art may be more fully appreciated. Additional features of the invention will be described hereinafter which form the subject of the claims of the present invention. It should be appreciated by those skilled in the art that the conception and the specific embodiment disclosed herein may be readily utilized as a basis for modifying or designing other method and apparatus for carrying out the same purposes of the present invention. It should also be realized by those skilled in the art that such equivalent methods and apparatus do not depart from the spirit and scope of the present invention as set forth in the appended claims.

BRIEF DESCRIPTION OF THE DRAWINGS

For a more complete understanding of the nature, objects and advantages of the present invention, reference should be had to the following detailed description taken in conjunction with the accompanying drawings in which:

FIG. 3 is an exploded perspective illustration of a portion of the internal mechanisms shown in FIGS. 1 and 2.

FIG. 13 is a schematic end elevational view of the apparatus constructed in accordance with the present invention as illustrated above but with motion imparting mechanisms coupled therewith.

Similar reference numerals refer to similar parts throughout the several Figures.

DETAILED DESCRIPTION OF THE INVENTION

Figure 1:
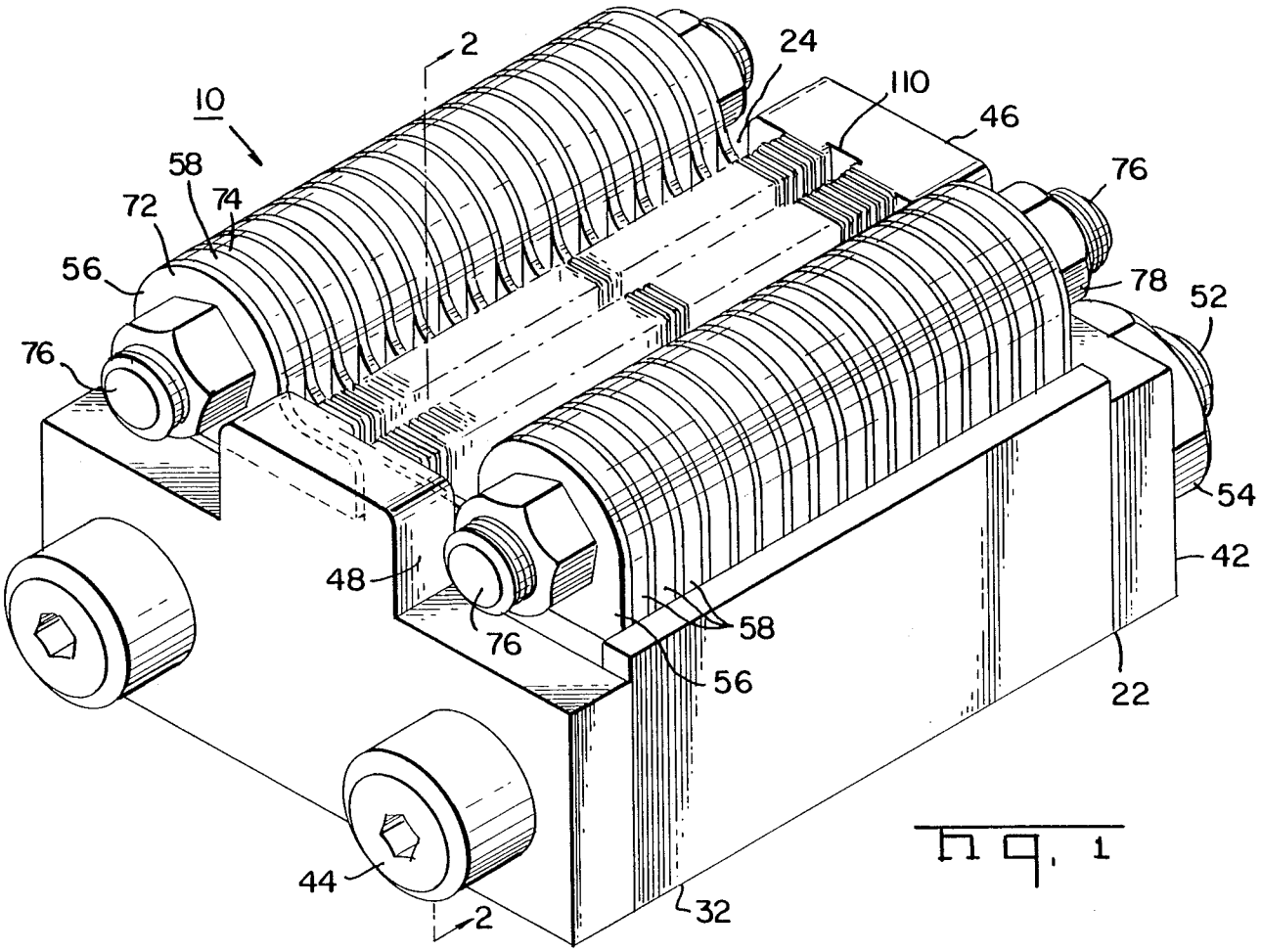
FIG. 1 is a perspective illustration of the present inventive apparatus for positioning, supporting and bending selected wires at the stripped free end of a ribbon cable.
Figure 2:
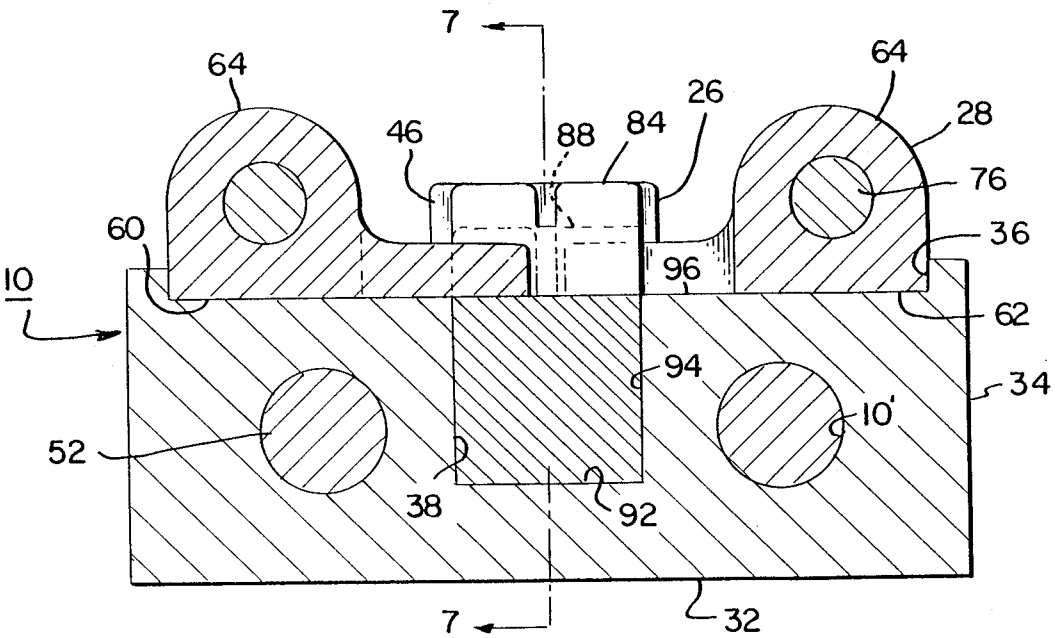
FIG. 2 is an end sectional view of the apparatus shown in FIG. 1 taken along line 2—2 of FIG. 1.
Figure 7:
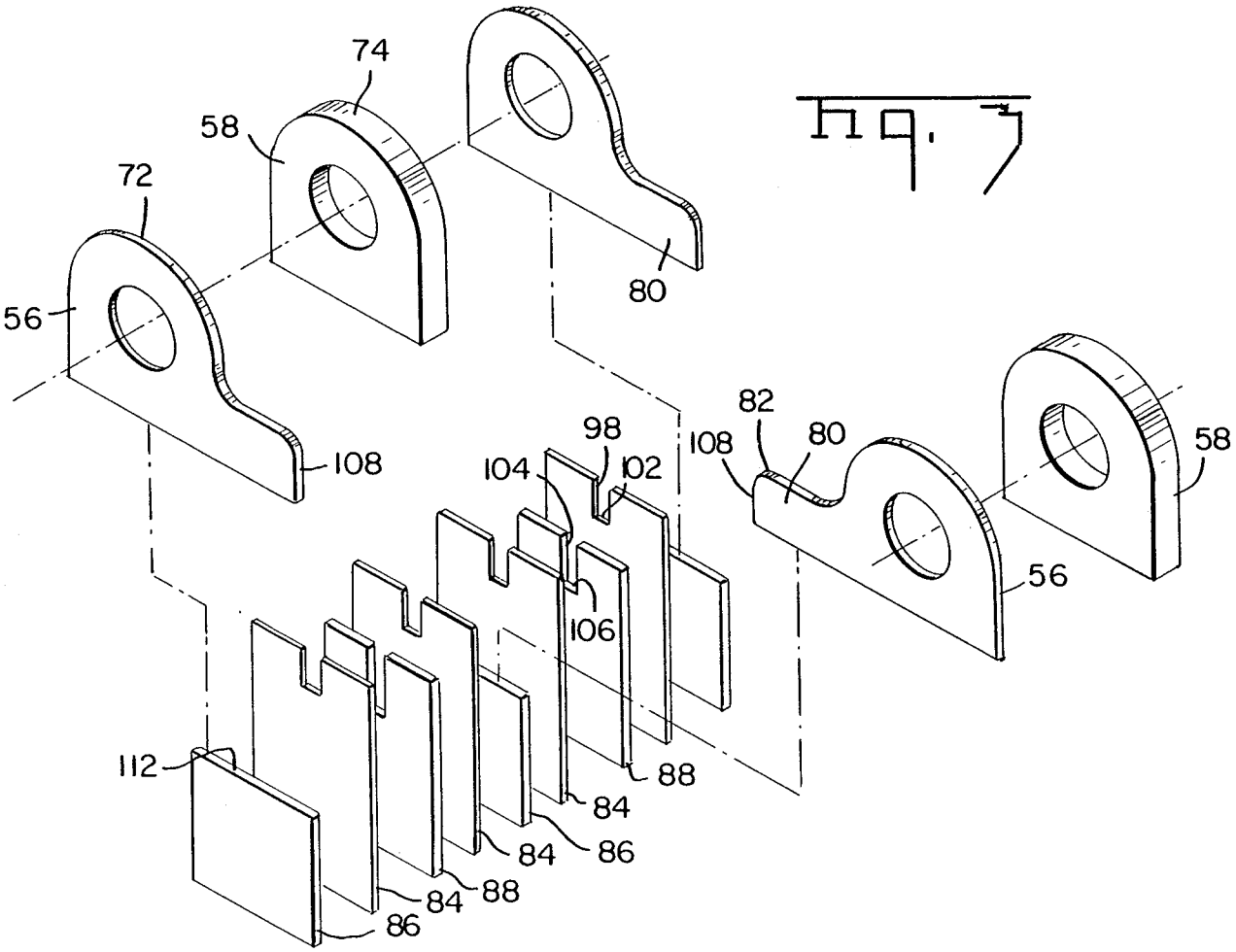
FIGS. 7 and 8 are sectional views of the apparatus shown in the previous Figures taken along line 7—7 of FIG. 2, FIG. 7 being without a cable and FIG. 8 being with a cable.

With particular reference to FIGS. 1 and 2, an apparatus 10 is shown for positioning, supporting and bending selected wires 12 and 14 at the stripped free end 16 of a ribbon cable 18. The apparatus is constructed in accordance with the primary embodiment of the present invention and functions for bending wires in accordance with the method of the present invention.

The wires 12 and 14 to be bent are located at the stripped free end 16 of a ribbon cable 18. The ribbon cable is formed of parallel wire within a web 20 of insulating material. The end-most wires of the ribbon cable are preferably ground wires 12 as is each alternate wire. Intermediate the ground wires 12 are signal wires 14 adapted to be bent to one side or the other for facilitating their individual coupling to a connector, not shown. The present invention is equally capable of bending wires for deployment in a wide variety of other configurations and arrangements within a ribbon cable.

The apparatus includes a fixture constructed of fixed external parts 22 and internal components 24 some of which are fixed 26 and some of which are movable 28 with respect to each other.

The external parts include a base 32 of precision, high-carbon steel machined to include a base and upstanding side walls 34. The upstanding side walls include a motion restricting lip 36 along the length of each side. The base also includes a central box-like opening or recess 38 extending from end to end. A pair of symmetrically located apertures 40 also extend from end to end. Located on each end are a pair of end plates 42, each end plate being provided with a pair of apertures 44 symmetrically located so that when the end plates 42 are located on the ends of the base, the apertures 40 of the base will be aligned with the apertures 44 of the end plates. Each end plate 42 includes an upwardly extending central portion 46 adapted to constrain the internal mechanisms. Each end plate also includes cutout portions 48 of such size and location as to allow for the free movement of the internal components 24.

Located through the apertures 40 and 44 of the base 32 and end plates 42 apparatus are a pair of bolts 52, shown as hexagonal socket head bolts with associated hexagonal nuts 54 to couple the base and end plates into a unitary composite assembly for positioning the internal components of the apparatus.

Figure 4:
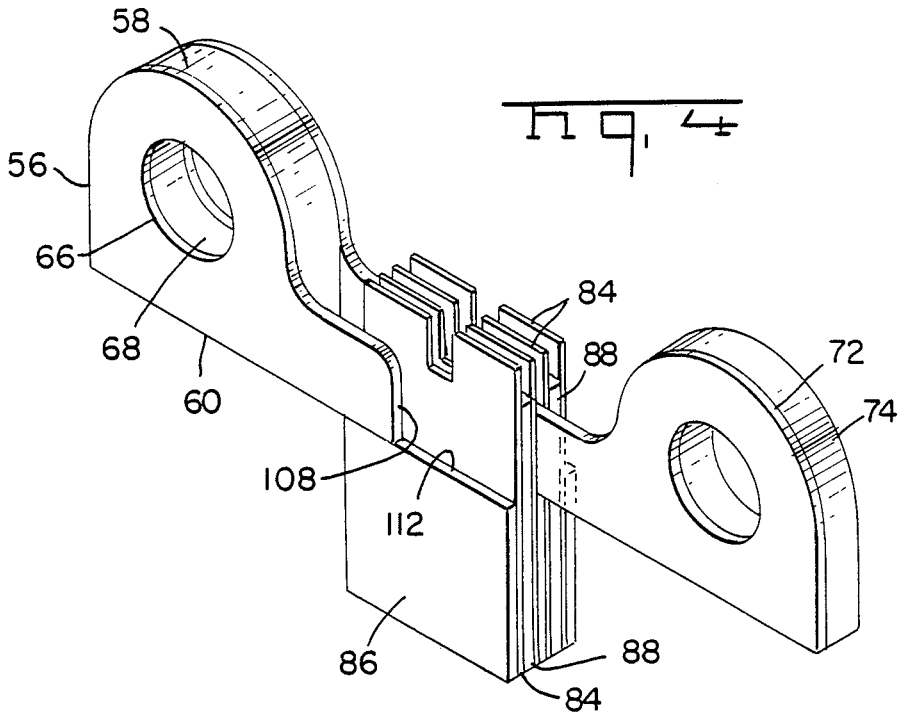
FIG. 4 is a perspective illustration of the parts of the apparatus as shown in FIG. 3 but with such parts shown in operative engagement with each other rather than in an exploded view.
Figure 5:
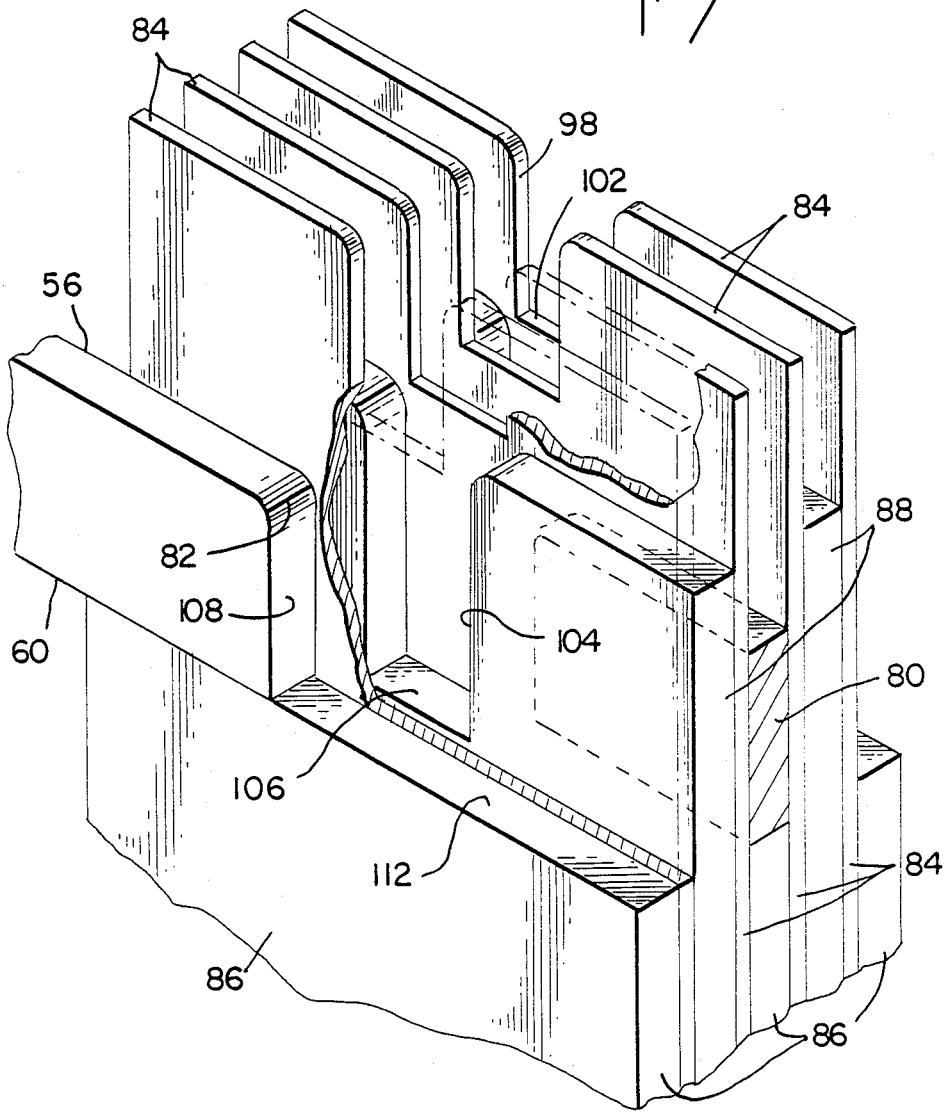
FIG. 5 is an enlarged perspective illustration similar to FIG. 4 but with parts broken away to shown certain internal constructions thereof.
Figure 7:
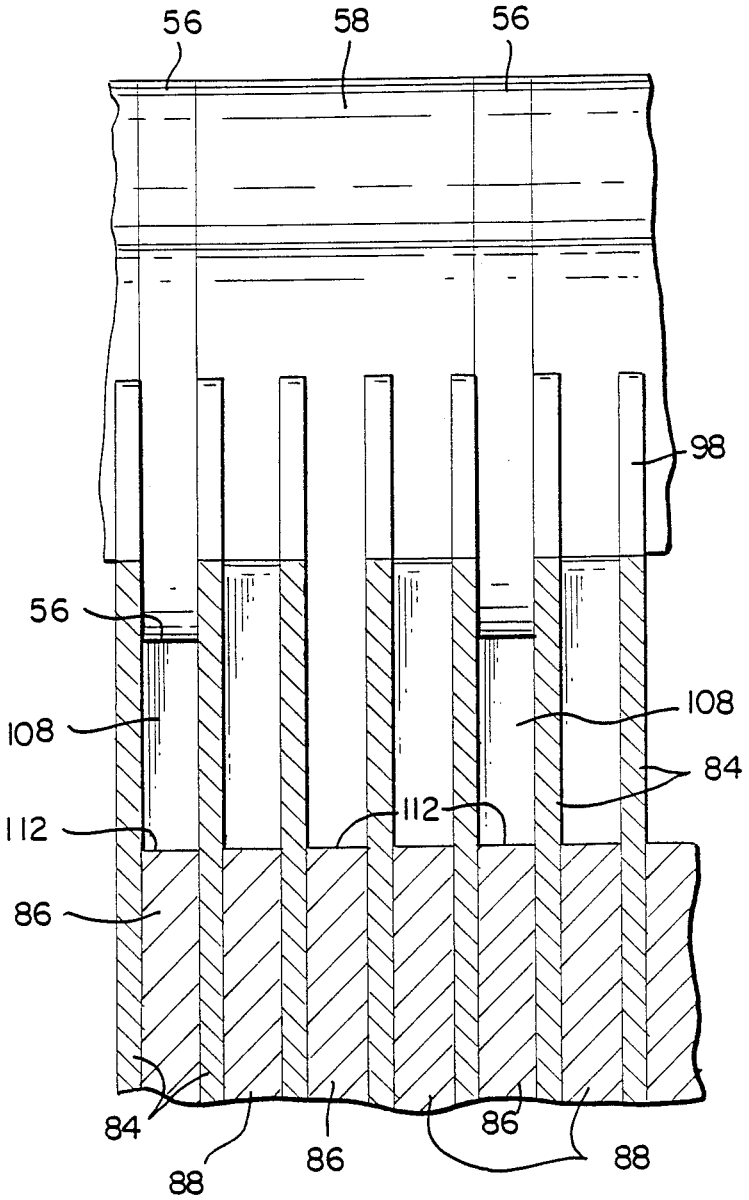
Figure 8:
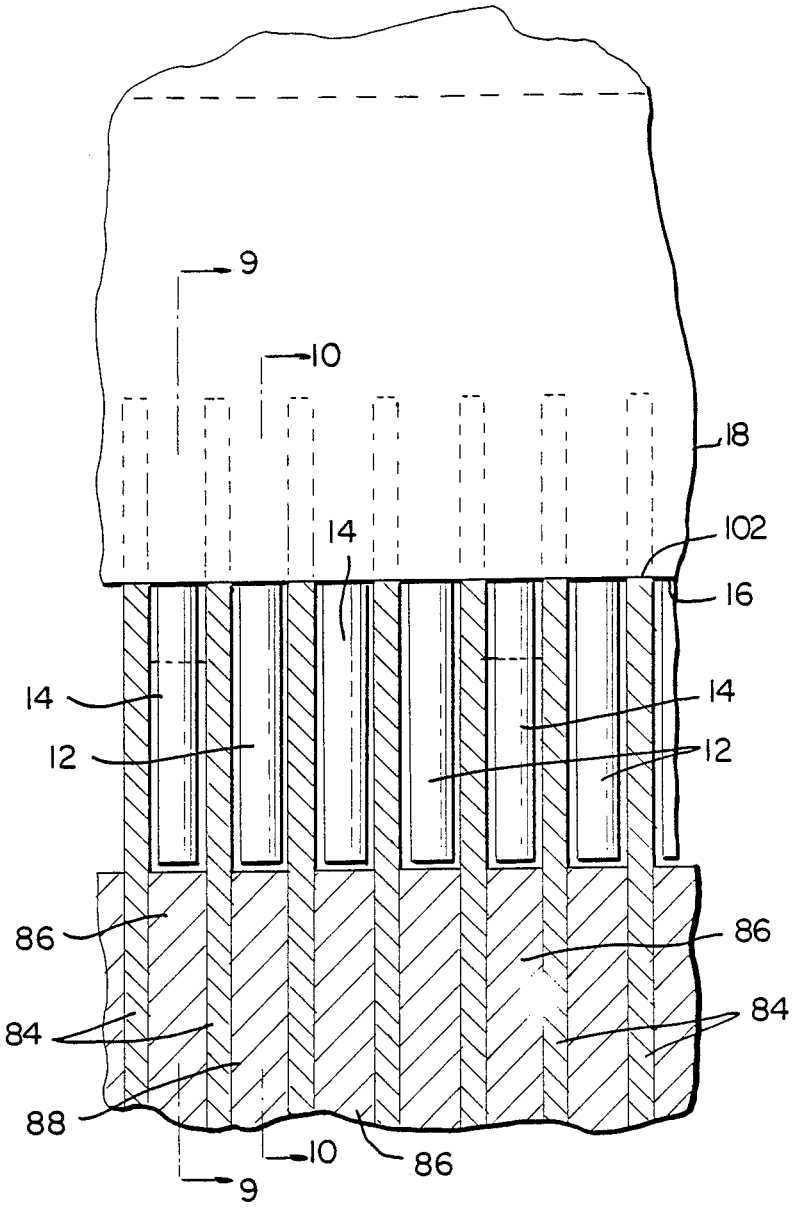

The internal components of the apparatus can be seen in FIGS. 1 and 2 but may be better understood by viewing their showings in FIGS. 3, 4 and 5 where only a limited number of like components are illustrated. Such internal components 24 include the movable components 28 and the fixed components 26. The movable components include bending fingers 56, equal in number to the number of wires to be bent, and spacers 58 located between each of the bending fingers. The bending fingers and spacers are each formed with flat lower faces 60 and 62 located in a common plane for reciprocably sliding in a horizontal plane. The bending fingers and spacers are arranged in two similar spaced sets 64 and are provided with apertures 66 and 68 of a common diameter, located on two parallel axes offset from each other in a common horizontal plane located above the plane on which they slide. The upper edges 72 and 74 of the bending fingers and spacers are curved for providing bearing surfaces for proper securement with respect to each other. A pair of threaded rods 76 extend through the apertures 66 and 68 for retaining the sets of bending fingers and spacers in a proper face-to-face or side-by-side relationship with respect to each other to form a stacked array. A hexagonal nut 78 is located at each end of each of the threaded rods 76 for securing together the supported components.

The bending or deploying fingers along with their associated spacers and threaded rods and nuts are located horizontally spaced from each other on opposite sides of a central vertical plane extending through the apparatus. Each of the bending fingers is provided with a forwardly extending portion 80 facing toward the central vertical plane of the apparatus and the bending fingers of the opposing set. The upper interior edge 82 of each forwardly extending portion of the bending fingers is formed as a smooth curve to facilitate the bending of wires.

Figure 9:
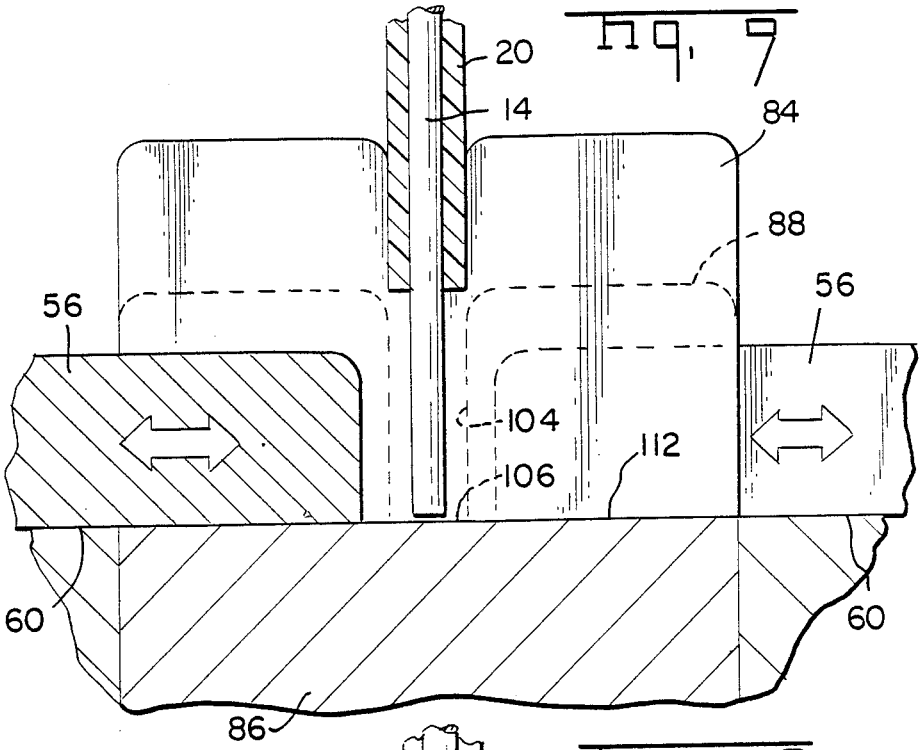
FIGS. 9 and 10 are sectional views of the apparatus shown in the previous Figures taken along lines 9—9 and 10—10, respectively, of FIG. 8 and showing the bending fingers in their retracted positions prior to bending the wires of the inserted ribbon cable.
Figure 10:
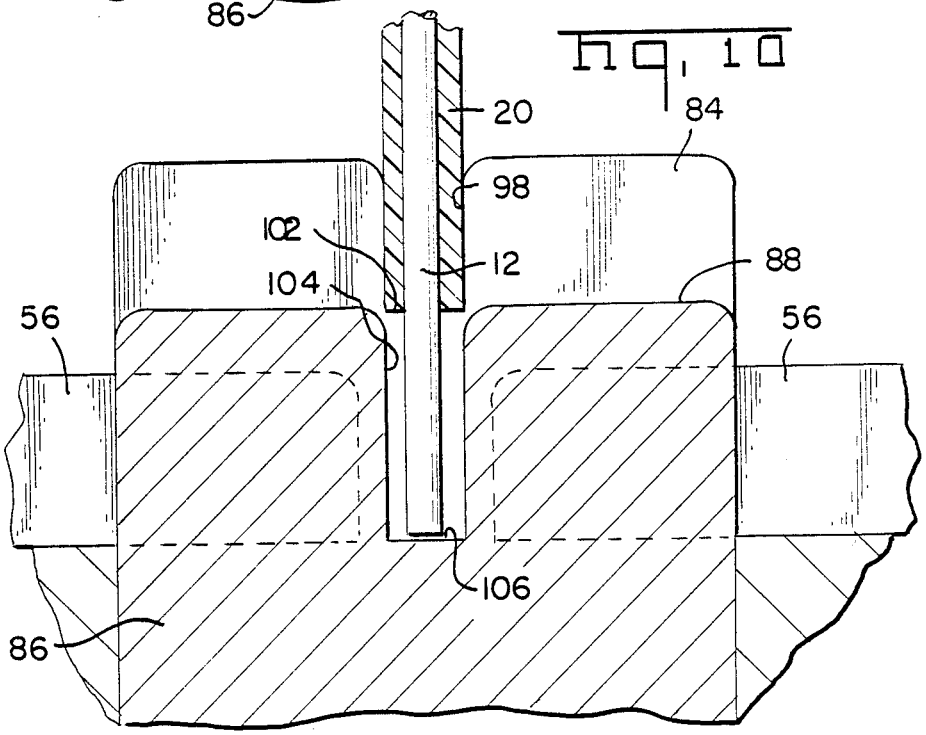
Figure 11:
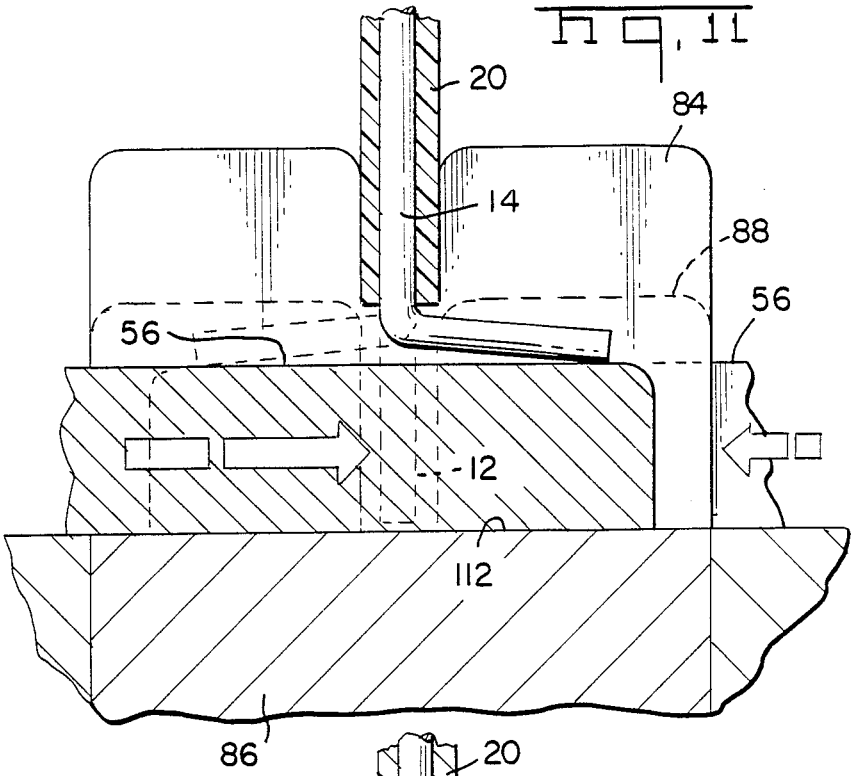
FIGS. 11 and 12 are sectional views of the apparatus shown in the previous Figures taken along lines 9—9 and 10—10, respectively, of FIG. 8, but showing the bending fingers in their advanced positions with selected wires of the ribbon cable having been bent.
Figure 12:
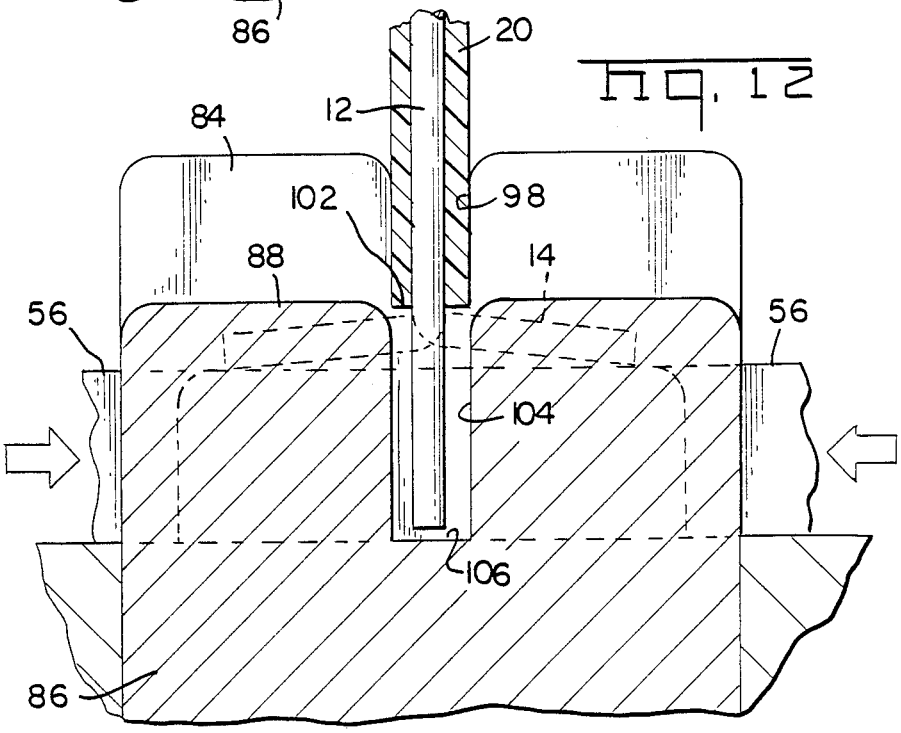
Figure 15:
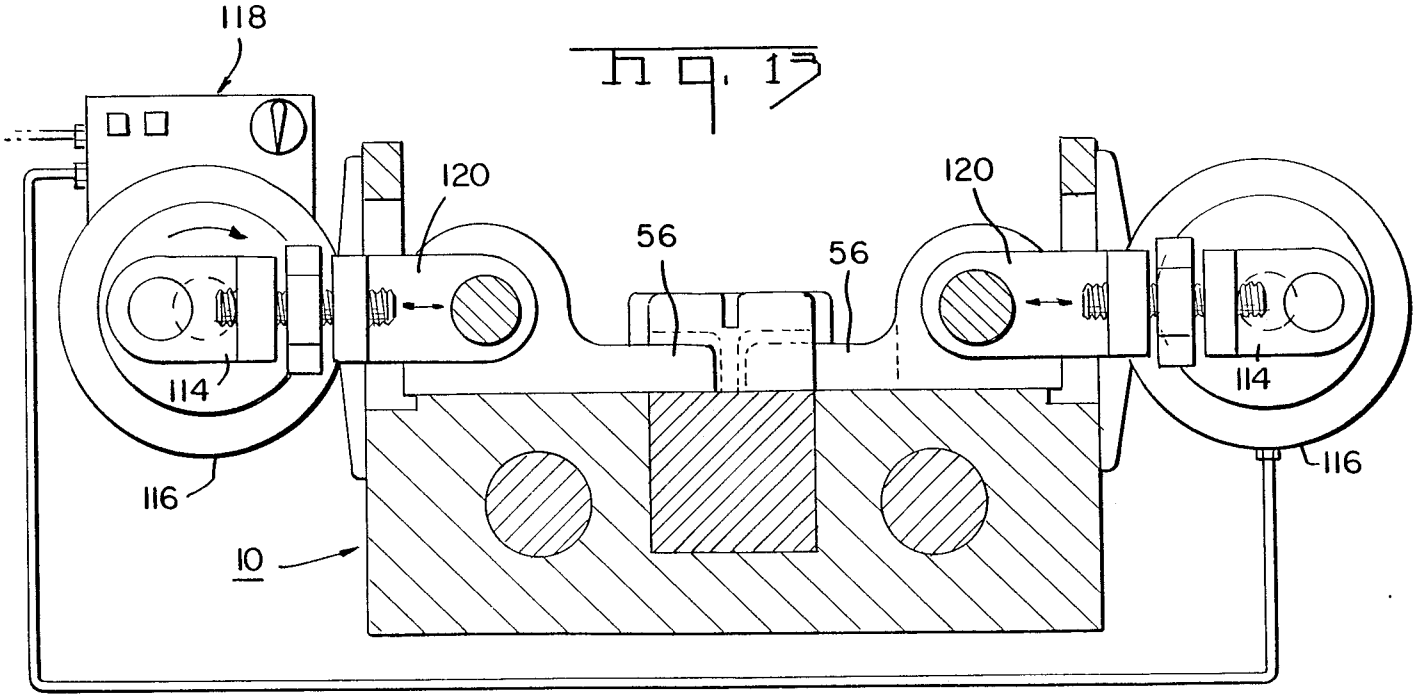

The bending fingers are adapted to move from their retracted positions as shown in FIGS. 1, 2, 4, 5, 9 and 10 to their advanced positions as shown in FIGS. 11 and 12 and then back to their retracted positions in a reciprocating cycle of operation for bending wires which may be positioned in their paths of travel as will be described more fully hereinafter.

The internal components also include fixed components 26 for positioning and supporting the stripped free end 16 of the ribbon cable 18 including its wires 14 to be bent. These fixed internal components also provide bearing and guiding surfaces for the bending fingers as they reciprocate in their paths of travel.

The fixed components 26 are plate-like members which include tall positioning shims 84, one less in number than the number of wires in the stripped free end of the ribbon cable. Located between each tall positioning shim 84 is either a short ground wire shim 86 or a short signal wire shim 88. These short shims 86 and 88 are shown, in the preferred embodiment, as alternating in position for constituting the spacers between each tall positioning shim 84. Each of the shims or plates 84, 86 and 88 has its lower edge in a common plane positionable upon the upper surface 92 of the base with their upwardly extending side edges located in alignment with the vertically extending walls 94 of the cutout. The tall positioning shims and the short ground wire shims extend upwardly above the upper edge 96 of the base while the short signal wire shims extend upwardly merely to the upper edge 96 of the base. The shims are of a number to fill the box-like opening 38 of the base from end plate to end plate 42 by which they are constrained from lateral movement. The shims are plate-like members arranged in a face-to-face or side-by-side relationship to form a stacked array.

For the purpose of this application, the apparatus will be described as being sized to receive, support and bend the wires of a one-inch ribbon cable having 81 wires, 41 being ground wires and 40 being signal wires. Each signal wire is located between adjacent ground wires. Each of the wires is 0.0080 inches in diameter with a spacing of 0.0125 inches between centerlines. In order to accommodate cables of these dimensions, the bending fingers are 0.0100 inches in thickness while the spacers 56 between the bending fingers 56 are 0.0400 inches in thickness. Forty fingers are required for each device, 20 per side, while 38 spacers are required, 19 per side between each of the adjacent bending fingers. A total of 80 tall positioning shims 84 are required while 41 short ground wire shims 88 and 40 short signal wire shims 86 are required. The short shims 86 and 88 are 0.0100 inches in thickness while the tall positioning shims 84 are 0.0025 inches in thickness. These dimensions are set forth herein for descriptive purposes only to provide for a clearer understanding of the present invention. Such dimensions should not be considered as limiting the invention in any manner since it should be readily appreciated that the invention could be readily utilized within a wide variety of dimensional parameters.

It should also be understood that the terms horizontal and vertical, upper and lower and the like are also used for descriptive purposes only since the present invention could readily be utilized vertically, horizontally, upside down, right side up, or in any angular orientation as may be desired for any particular purpose.

The tall positioning shims 84 are each provided along their upper edge with a downwardly extending notch 98 terminating in an abutment or bottoming surface 102. The abutment surface is located above the upper edge 96 of the base and constitutes a reference surface against which the insulating web 20 of the ribbon cable between the wires may be located for the bending operation. It should be understood that the ribbon cable 18 has been stripped so that the free ends of the wires are at a precise predetermined distance from the adjacent free end 16 of the web. Thus, when an operator inserts the stripped end 16 of the ribbon cable into the notches 98 of the tall positioning shim, each such positioning shim will be contacted by the web at a location between adjacent wires. The wires then extend downwardly to nearly touch an adjacent portion of a short ground wire shim or short signal wire shim.

Located immediately exteriorly of the two endmost tall positioning shims are short ground wire shims 88. Each ground wire shim is provided with a notch 104 extending downwardly from its upper edge. When the ground wires 12 are thus positioned within the notches 104 of the short ground wire shims, they will be encompassed on all four sides in a chamber defined by faces of tall shims beneath their notch 98 and the edges of the notch 104 of the short ground wire shim 88. The abutment or bottoming surface 106 of the notch 104 of the short ground wire shim constrains the end of each ground wire. Note FIGS. 10 and 12.

Each signal wire 14 is constrained in a chamber defined from end to end by the faces of the tall positioning shims 84 and from front to back by the vertical leading edges 108 of the bending fingers. Note FIGS. 9 and 10.

In order to accommodate the insulating material at the edges of the web of the ribbon cable and to constitute a locating surface for the positioning of the ribbon cable and its wires, notches 110 are formed in the end plates 42 facing each other and the fixed internal components. The notches 110 extend downwardly a distance and terminate on a common horizontal plane with the abutment surfaces 102 of the tall positioning shims 84. In this manner, the bottom surfaces of the notches 110 also assist in locating the wires to be bent to a proper depth within the apparatus.

Figure 6:
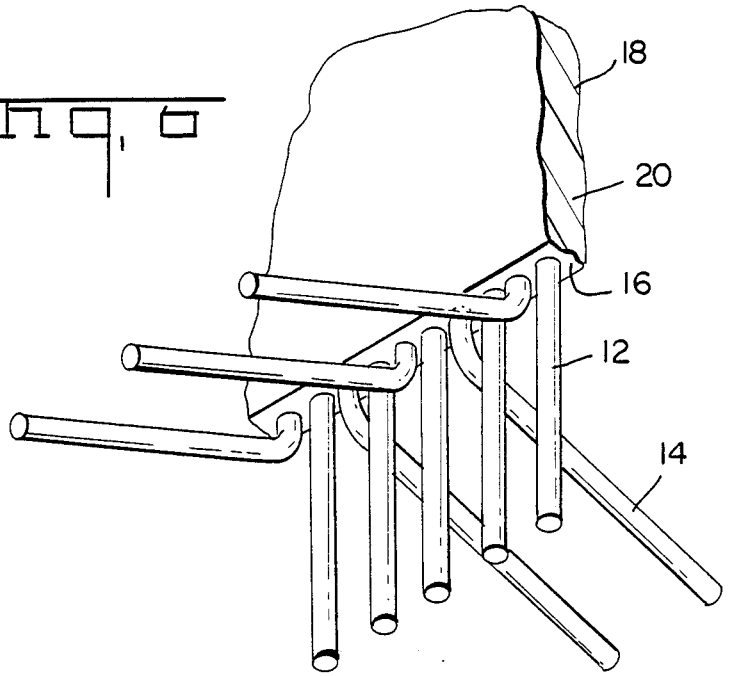
FIG. 6 is a partial perspective illustration of a portion of a ribbon cable illustrating the stripped free end with its wires having been bent by the method and apparatus of the present invention.

The motion of the bending fingers can be seen and understood by referring to FIGS. 9 through 12. The bending fingers 56 are located to have their lower edges 60 rest on and be guided for reciprocal horizontal movement by their mounting on the upper edges 112 of the signal wire shims 86. When the bending fingers are moved from their retracted positions as shown in FIGS. 9 and 10 to their advanced positions as shown in FIGS. 11 and 12, they will contact and bend alternate signal wires in alternate directions to the proper angle, 70 degrees in the disclosed preferred embodiment as seen in FIGS. 6, 11 and 12. The size and material of the wires is such that when once bent they will stay bent unless acted upon by an additional force. Straightline movement of the bending fingers is insured due to their being constrained by the tall positioning shims 84 on opposite sides of the bending fingers. The tall positioning shims also function to provide rigidity to the wires in their areas encapsulated by the web so that equal and opposite forces by the bending fingers will insure the bending of the wires along a common line extending through all of the signal wires.

With the bending fingers in their retracted position after the reciprocal bending movement, the wires of the free end of the ribbon cable can simply be withdrawn upwardly from the apparatus for use with a connector in the intended manner. As the bending fingers first contact the wires, then bending begins. Further finger movement bends the wires further to a greater angle. If desired, movement of the fingers could be terminated to limit the angle of bend to less than 70 degrees.

FIG. 13 is a schematic side elevational view of an apparatus constructed in accordance with the primary embodiment of the invention. The invention as previously described could readily be utilized by moving the bending fingers 56 equally and oppositely by hand. It is preferred, however, that the threaded rods 76 supporting the bending fingers 56 and their spacers 58 be secured to a motion-imparting device for mechanically providing the desired motion concurrently with equal force and speed. Motion-imparting linkage assemblies 114 coupled between the bending fingers 56 and stepping motors 116, activated by a switch on a control panel 118 are preferably employed to effect this result. Further, it is preferred to provide the linkage assemblies 114 with adjusting nuts 120 to adjust the throw of the bending fingers so that a greater or lesser angle may be imparted to the signal wires as a function of the extent of the throw and the amount of motion of the bending fingers.

It should also be understood that the signal wires 14 need not be bent alternately in one direction and then the other. It should be appreciated that in some instances one or a plurality of adjacent signal wires may be bent in a first direction followed by one or a plurality of adjacent signal wires which may be bent in an opposite direction. To this end, the use of the threaded rods 76 allows the repositioning of the bending fingers to other than the alternating arrangement as disclosed hereinabove.

In operation and use, the method of the present invention includes the providing of a ribbon cable 18 with a stripped free end 16 having parallel, alternating, ground and signal wires 12 and 14 all encased in an insulating web 20. The wires 12 and 14 of the stripped free end are inserted into the notches 98 of the tall positioning shims 84 at the top of the apparatus with one edge of the web of the ribbon cable in sliding contact with a locating and aligning notch 110 of an end plate 42. Each of the wires is located in spaces between adjacent tall positioning shims with the web between the stripped wires contacting the edge 102 of the notches 98 of the tall positioning shims 84 to position the wires to a proper depth within the apparatus. The free ends of the wires which function as ground wires 12 are located within the notches 104 of short ground wire shims 88 while the free ends of the signal wires 14 are located between the free ends 108 of the retracted bending fingers 56 and the tall positioning shims 84, beneath their notches 98.

A reciprocating motion is then imparted to the bending fingers as by the arrangement of stepping motors 116 and linkage assemblies 114 operable concurrently through the actuation of a common switch on the control panel 118. Such motion could also be imparted by hand. The bending fingers are thus driven to slide in a horizontal plane with their lower surfaces 60 upon the upper surfaces 112 of the short signal wire shims 86 between adjacent tall positioning shims 84 to thereby bend the signal wires in one direction or the other as a function of the direction of motion of the bending fingers. The upper extends of the tall positioning shims 84 preclude lateral shifting of the bending fingers 56 during their movement. The notches 98 of the tall positioning shims 84 constrain the wires from motion above the bends. The resulting ribbon cable end with its selectively, predetermined bends in the free, stripped ends of its wires may then be removed from the apparatus by lifting the ribbon cable upwardly while the bending fingers are in their retracted positions.

The present disclosure includes that information contained in the appended claims as well as that in the foregoing description. Although the invention has been described in its preferred forms or embodiments with a certain degree of particularity, it is understood that the present disclosure of the preferred form has been made only by way of example and that numerous changes in the details of construction, fabrication and use, including the combination and arrangement of parts and method steps, may be resorted to without departing from the spirit and scope of the invention.

What is claimed is:

1. Apparatus for deploying selected, individual wires at the stripped free end of a ribbon cable, the ribbon cable being formed of spaced, parallel, electrical wires in an insulating web, said apparatus comprising:

plate-like members coupled with respect to each other and adapted to position the individual wires at the stripped free end of a received ribbon cable; and fingers operatively coupled with respect to each other and reciprocably arranged for movement contacting and deploying selected, individual, electrical wires of the received and supported ribbon cable.

2. The apparatus as set forth in claim 1 wherein said plate-like members include a plurality of tall positioning plates located in a parallel array to separate each wire of the ribbon cable received by said apparatus.

3. The apparatus as set forth in claim 2 wherein said tall positioning plates are each formed with a downwardly extending notch terminating in a surface to be contacted by the web of a received ribbon cable between its stripped wires for properly locating the ribbon cable and its wires within said apparatus.

4. The apparatus as set forth in claim 3 wherein said plate-like members further include short first wire plates, each located between some adjacent tall positioning plates, each said short first wire plate having an upper edge against which a finger may reciprocate for the deploying of wires.

5. The apparatus as set forth in claim 4 wherein said plate-like members further include short second wire plates, each located between other adjacent tall wire plates, each said short second wire plate having a downwardly extending notch for receiving a second wire of the received ribbon cable.

6. The apparatus as set forth in claim 5 wherein said short first wire plates and short second wire plates are alternately located between alternate tall positioning plates.

7. The apparatus as set forth in claim 6 wherein said fingers are located in two sets, one set on each side of the wires of a received ribbon cable.

8. The apparatus as set forth in claim 7 wherein said fingers are supported on a pair of spaced, parallel rods and further including spacers supported on said rods between said fingers.

9. The apparatus as set forth in claim 8 wherein said fingers are adapted, when reciprocated, to contact and deploy individual first wires.

10. The apparatus as set forth in claim 9 wherein said fingers of each set are movable oppositely to contact and deploy alternate first wires in opposite directions.

11. The apparatus as set forth in claim 10 and further including motor means to concurrently reciprocate said sets of fingers from their retracted positions out of contact with the first wires of the ribbon cable to be deployed to their advanced positions in contact with the wires of the ribbon cable to be deployed then back to their retracted positions.

12. The apparatus as set forth in claim 11 and further including means to vary the throw of said fingers.

13. Apparatus for bending selected, individual, stripped, electrical wires at the free end of a ribbon cable, the ribbon cable being formed of spaced parallel wires in an insulating web, said apparatus comprising:

a base having a recess;

fixed components within said recess to individually position the stripped wires of a received ribbon cable, said fixed components including tall positioning shims with notches extending downwardly from their upper edges to contact a ribbon cable between its stripped wires and to properly position the web and the stripped wires with respect to said fixed components, said fixed components also including short ground wire shims located between some of said tall positioning shims to receive, thereadjacent, ground wires of the received ribbon cable, said fixed components also including short signal wire shims located between others of said tall positioning shims to receive, thereadjacent, signal wires of the received ribbon cable; and bending fingers operatively associated with said fixed components for reciprocable movement with respect to said fixed components, said bending fingers being located in two rows on opposite sides of the wires to be bent for movement from retracted positions on opposite sides of the wires to be bent, to advanced positions wherein the leading edges of said bending fingers may contact and bend selected, individual stripped signal wires of a ribbon cable supported and positioned by said fixed components.

14. The apparatus as set forth in claim 13 and further including motor means to concurrently reciprocate said rows of bending fingers between their retracted positions and their advanced positions.

15. The apparatus as set forth in claim 14 and further including means to selectively increase and decrease the throw of said bending fingers.

16. The apparatus as set forth in claim 13 wherein said short ground wire shims each include a downwardly extending notch for constituting, in association with the tall positioning shims beneath its notches, a chamber for receiving the ground wires.

17. The apparatus as set forth in claim 16 wherein said short signal wire shims constitute, in association with the tall positioning shims beneath their notches and the leading edges of the retracted bending fingers, a chamber for receiving the signal wires.

18. The apparatus as set forth in claim 13 wherein said fixed components include a vertically oriented, laterally disposed, locating edge against which an edge of the received ribbon cable may be positioned for guiding the ribbon cable into said apparatus.

19. The apparatus as set forth in claim 13 wherein said signal wire shims and ground wire shims are about 0.0100 inches thick to receive thereadjacent signal wires with a diameter of about 0.0080 inches.

20. The apparatus as set forth in claim 14 wherein said tall positioning shims are about 0.0025 inches thick to accommodate therebetween adjacent wires and bending fingers.

21. Apparatus for deploying individual wires of the stripped free end of a ribbon cable, the ribbon cable being formed of spaced, parallel wires in an insulating web, said apparatus comprising:

a plurality of tall plate-like members and short plate-like members alternately positioned and removably secured with respect to each other in a face to face array, said tall plate-like members having free edges to be contacted by the insulation of a ribbon cable at regions between the wires at the stripped free end to thereby separate and position the individual wires adjacent said short plate-like members and between said tall plate-like members; and deployment means located in operative association with respect to plate-like members and arranged for reciprocable movement between tall plate-like members for contacting and deploying individual wires of the received and supported ribbon cable.

22. The apparatus as set forth in claim 21 wherein some of said short plate-like members have notches for receiving some of the individual wires to thereby preclude such wires from being contacted by said deployment means.

23. The apparatus as set forth in claim 22 wherein others of said short plate-like members do not have notches to thereby allow such wires thereadjacent to be contacted by said deployment means.

24. The apparatus as set forth in claim 23 wherein said short plate-like members are about 0.0100 inches thick to receive thereadjacent signal wires of a diameter of about 0.008 inches and wherein said tall plate-like members are about 0.0025 inches thick to accommodate therebetween adjacent wires and deployment means.

25. A method of bending selected, individual wires at the stripped free end of a ribbon cable formed of parallel electrical wires in an insulating web, said method comprising the steps of:

providing a base having an opening;

positioning fixed components within said opening to support the individual wires of a received ribbon cable, said fixed components including tall positioning shims with notches extending downwardly from their upper edges, said fixed components also including short signal wire shims located between some of said tall positioning shims to receive, adjacent their upper edges, alternate wires of the received ribbon cable, said fixed components also including short ground wire shims located between others of said tall positioning shims to receive wires other than the alternate wires of the received ribbon cable;

inserting the stripped free end of a ribbon cable into said fixed components with the insulating web, between its stripped wires, in positioning contact with said notches of said tall positioning shims and with the individual stripped wires of the ribbon cable separated one from the other by said tall positioning shims; and moving, from a retracted position to an advanced position, bending fingers within said opening, said bending fingers arranged in two rows located out of contact with the wires to be when in their retracted position and in bending contact with the wires to be bent when in their advanced positions whereby the leading edges of said bending fingers may contact and bend selected signal wires of the supported and positioned ribbon cable during movement from the retracted to the advanced positions.

26. The method as set forth in claim 25 wherein the lower edges of said bending fingers bear against the upper edges of said short signal wire shims during the moving of said bending fingers between the retracted to the advanced positions.

27. The method as set forth in claim 26 wherein the facing surfaces of said tall positioning shims contact the side faces of said bending fingers to preclude the lateral movement of the bending fingers during the moving of said bending fingers between their retracted to the advanced positions.

28. The method as set forth in claim 25 and further including the steps of moving the bending fingers from their advanced position to their retracted position and then withdrawing the ribbon cable with its bent signal wires from said apparatus.

29. The method as set forth in claim 25 and further including the step of energizing motor means to concurrently reciprocate said two rows of bending fingers from their retracted positions, to their advanced positions and back to their retracted positions.

30. The method as set forth in claim 25 and further including the step of selectively varying the throw of said bending fingers.

31. The method as set forth in claim 25 wherein said signal wire shims and ground wire shims are about 0.0100 inches thick to receive thereadjacent signal wires of a diameter of about 0.008 inches.

32. The method as set forth in claim 31 wherein said tall positioning shims are about 0.0025 inches thick to accommodate therebetween adjacent wires and adjacent bending fingers.

* * * * *